US009809897B2

(12) United States Patent
Chen et al.

(10) Patent No.: US 9,809,897 B2
(45) Date of Patent: Nov. 7, 2017

(54) METAL PLATING APPARATUS AND METHOD USING SOLENOID COIL

(71) Applicant: Taiwan Semiconductor Manufacturing Company, Ltd., Hsin-Chu (TW)

(72) Inventors: Hsili Chen, Tainan (TW); Kuan-Hsiao Lin, Daliao Township (TW); Chung-Yen Yang, Tainan (TW); Shao-Chien Yang, Taipei (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 276 days.

(21) Appl. No.: 13/801,081

(22) Filed: Mar. 13, 2013

(65) Prior Publication Data

US 2014/0262796 A1 Sep. 18, 2014

(51) Int. Cl.

| | |
|---|---|
| ***C25D 7/12*** | (2006.01) |
| ***C25D 17/00*** | (2006.01) |
| ***C25D 17/10*** | (2006.01) |
| ***C25D 5/00*** | (2006.01) |

(52) U.S. Cl.

CPC ..... *C25D 17/001* (2013.01); *C25D 5/006* (2013.01); *C25D 7/12* (2013.01); *C25D 17/10* (2013.01)

(58) Field of Classification Search

CPC ..... C25D 5/003; C25D 17/002; C25D 7/12–7/126; C25D 5/006; H01F 5/00–5/06; H01F 7/06–7/206

See application file for complete search history.

(56) References Cited

U.S. PATENT DOCUMENTS

| | | | | |
|---|---|---|---|---|
| 2,518,574 | A * | 8/1950 | Skopecek | B01D 3/4205 137/624.13 |
| 3,141,837 | A * | 7/1964 | Edelman | 205/82 |
| 6,103,085 | A * | 8/2000 | Woo et al. | 205/143 |
| 6,409,903 | B1 * | 6/2002 | Chung | C25D 5/18 204/229.5 |
| 2002/0046952 | A1 * | 4/2002 | Graham | C25D 7/12 205/99 |
| 2003/0029509 | A1 * | 2/2003 | Sato | F16K 24/04 137/625.65 |
| 2004/0035695 | A1 * | 2/2004 | Dordi et al. | 204/252 |
| 2004/0138075 | A1 * | 7/2004 | Brown et al. | 508/223 |

(Continued)

FOREIGN PATENT DOCUMENTS

| | | | | |
|---|---|---|---|---|
| JP | H10-135034 | * | 5/1998 | H01F 7/126 |
| KR | 2001-0010788 A | * | 2/2001 | |

OTHER PUBLICATIONS

Spellman and Whiting, The Handbook of Safety Engineering (2010).*

(Continued)

*Primary Examiner* — James Lin
*Assistant Examiner* — Ho-Sung Chung
(74) *Attorney, Agent, or Firm* — Slater Matsil, LLP

(57) ABSTRACT

A metal plating apparatus includes a chemical bath chamber, an anode disposed at a bottom portion of the chemical bath chamber, and a cathode disposed at a top portion of the chemical bath chamber. A solenoid coil is disposed within the chemical bath chamber between the anode and the cathode. The solenoid coil is arranged to apply a magnetic field during a metal plating process in a direction from the anode to the cathode.

19 Claims, 3 Drawing Sheets

(56) References Cited

U.S. PATENT DOCUMENTS

| | | | | |
|---|---|---|---|---|
| 2006/0201814 | A1* | 9/2006 | Hafezi et al. | 205/102 |
| 2007/0174982 | A1* | 8/2007 | Lin | 15/77 |
| 2008/0083624 | A1* | 4/2008 | Kim | H01L 21/2885 205/89 |
| 2008/0178460 | A1* | 7/2008 | Woodruff et al. | 29/592.1 |
| 2009/0071707 | A1* | 3/2009 | Endo et al. | 174/266 |
| 2009/0098432 | A1* | 4/2009 | Rosenberg et al. | 429/30 |

OTHER PUBLICATIONS

Choi et al., KR 2001-0010788 A, Machine Translation (2001).*
Ohashi et al., English Translation, H10-135034 (1998).*
Park, B. et al., "Effets of a magnetic field on the coper metallization using the electroplating process," wwww.sciencedirect.com, Microelectronic Eng. 85, 2008, pp. 308-314.

* cited by examiner

METAL PLATING APPARATUS AND METHOD USING SOLENOID COIL

TECHNICAL FIELD

The present disclosure relates generally to an integrated circuit process and more particularly to metal plating.

BACKGROUND

Some metal plating process for integrated circuit fabrication faces challenges such as slow deposition rate, long plating duration and low wafer per hour (WPH) production. More efficient metal plating apparatus and method with uniform deposition are desirable.

BRIEF DESCRIPTION OF THE DRAWINGS

Reference is now made to the following descriptions taken in conjunction with the accompanying drawings, in which.

DETAILED DESCRIPTION

Figure 1:
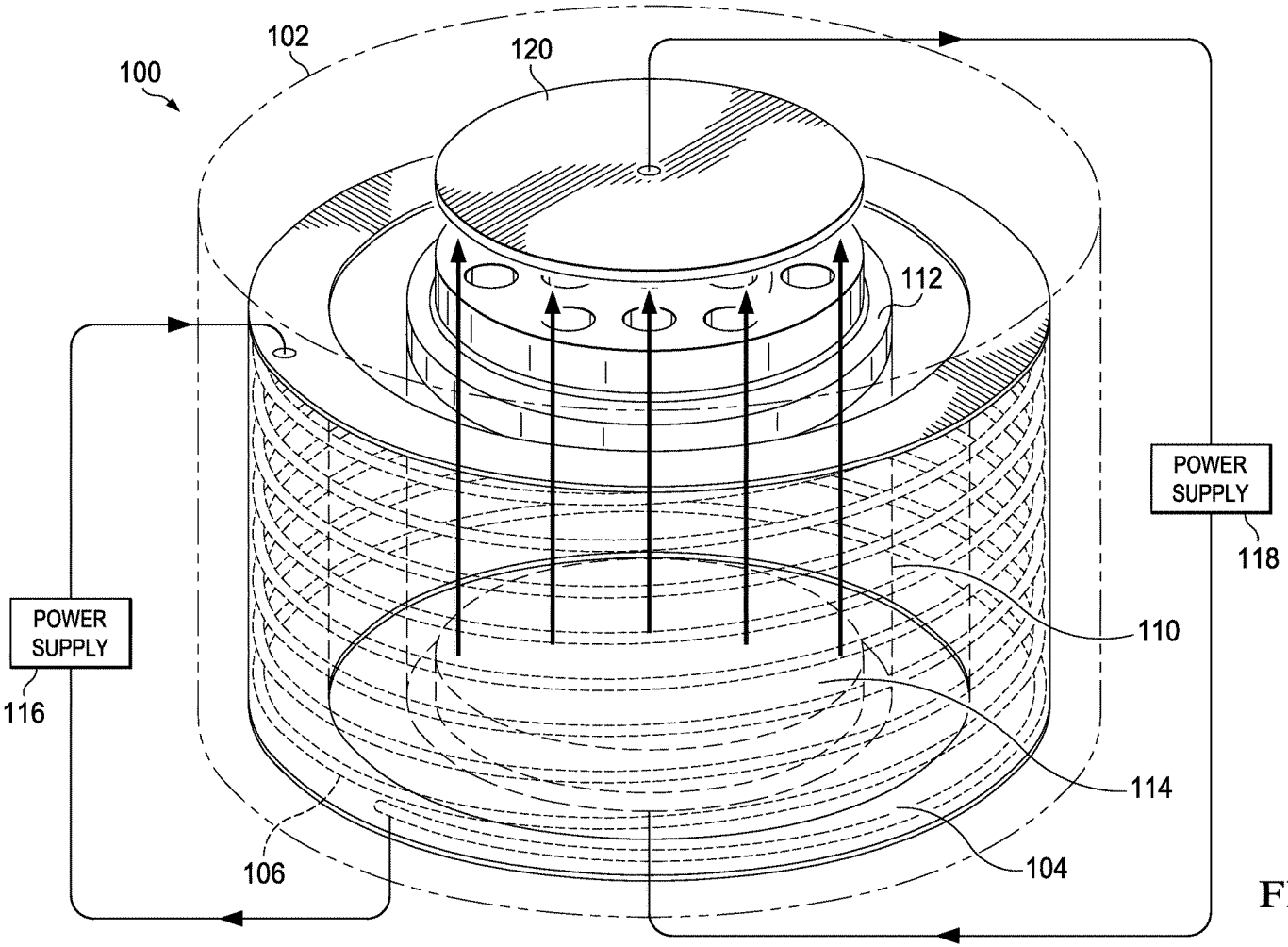
FIG. 1 is a schematic diagram of an exemplary metal plating apparatus according to some embodiments.

The making and using of various embodiments are discussed in detail below. It should be appreciated, however, that the present disclosure provides many applicable inventive concepts that can be embodied in a wide variety of specific contexts. The specific embodiments discussed are merely illustrative of specific ways to make and use, and do not limit the scope of the disclosure.

In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "lower," "upper," "horizontal," "vertical," "above," "over," "below," "beneath," "up," "down," "top," "bottom," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

FIG. 1 is a schematic diagram of an exemplary metal plating apparatus according to some embodiments. A metal plating apparatus 100 includes a chemical bath chamber 102, an anode 114 disposed at the bottom portion of the chemical bath chamber 102, and a cathode 120 (e.g., a wafer) disposed at the top portion of the chemical bath chamber 120. A solenoid coil 106 is disposed within the chemical bath chamber 102 between the anode 114 and the cathode 120 and arranged to apply a magnetic field B during a metal plating process in a direction from the anode 114 to the cathode 120.

Electrolyte such as copper sulphate (CuSO4) solution or any other suitable solution is filled inside the chemical bath chamber 102 for the metal plating process. In some embodiments, the chemical bath chamber 102 has an inner diameter of about 40 cm, an outer diameter of about 45 cm, and a height of about 60 cm. The chemical bath chamber 102 comprises Teflon or any other suitable material and the size can vary depending on applications.

In some embodiments, a wafer being plated functions as the cathode 120 and the plating side of the wafer faces the anode 114. In one example, the anode 114 has a thickness of about 3 cm and comprises copper or any other suitable material.

In some embodiments, a coil frame 104 provides a waterproof enclosure of the solenoid coil 106 within the chemical bath chamber 102. In some embodiments the coil frame 104 has an inner diameter of about 280 mm and an outer diameter of 380 mm, and comprises polyoxymethylene (POM), plastic, silicone, Teflon, any combination thereof, or any other suitable material. One skilled in the art will recognize that the dimensions and diameters provided in this disclosure are for the illustrated embodiments only and will vary according to, e.g., the diameter of the wafers being processed. It is contemplated that as wafer diameters increase, the diameters of the coil frame and other elements will also increase, as may other dimensions disclosed herein.

In some embodiments, the solenoid coil 106 has a diameter of 1.6 mm-2.4 mm, and a wire length of 20 m or more can be wound for the solenoid coil 106. The solenoid coil 106 comprises copper or any other suitable material. In some embodiments, the solenoid coil 106 may have a Teflon coating to isolate and protect it from the electrolyte within the chemical bath chamber 102.

Figure 2:
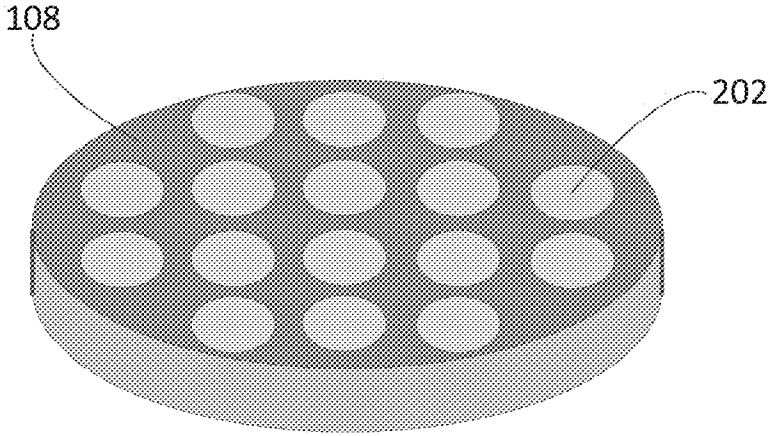
FIG. 2 is a schematic diagram of an exemplary metal block of the metal plating apparatus in FIG. 1 according to some embodiments.

In some embodiments, a metal block 108 enhances the magnetic field B from the solenoid coil 106 and has holes to allow generally uniform movement of the electrolyte in the chemical bath chamber 102 through the holes as shown in FIG. 2. In one example, the metal block 108 has a height of about 20 mm, a diameter of about 200 mm, has uniformly distributed holes (with a diameter of 15 mm), and is separated from the cathode (e.g., wafer) by about 30 mm. In some embodiments, the metal block 108 enhances the magnetic field B from about 200 gauss (Gs) to about 500 Gs.

The metal block 108 comprises magnetically conductive material such as metal, e.g., iron, nickel, iron-aluminum alloy, cobalt, low carbon steel, any combination thereof, or any other suitable material. In some embodiments, the metal block 108 may have a Teflon coating to isolate and protect it from the electrolyte within the chemical bath chamber 102. In some embodiments, the permeability of the metal block 108 is at least 100 H/m.

In some embodiments, an anode chamber 110 is disposed within the chemical bath chamber 102 and inside the solenoid coil 106. The anode chamber 110 has a cylinder shape with open ends in FIG. 1. The anode chamber 110 has a side wall that surrounds the anode 114 at the bottom portion of the chemical bath chamber 102. In one example, the anode chamber 110 has an inner diameter of about 21 cm, an outer diameter of about 25 cm, and a height of about 11 cm. The anode chamber 110 comprises polyoxymethylene (POM), plastic, silicone, Teflon, any combination thereof, or any other suitable material.

In some embodiments, a mesh cover (membrane) 112 is placed over the anode chamber 110. The mesh cover 112 comprises hydrophilic polyethylene, other synthetic fabric, or any other suitable material. The anode chamber 110 and the mesh cover 112 helps to contain byproducts from copper sludge and/or organic additives during the metal plating process.

The power supply 116 is coupled to the solenoid coil 106 to provide the magnetic field B in the direction from the anode 114 to the cathode 120 (e.g., a wafer). In some embodiments, the voltage of the power supply 116 is 80 V in direct current (DC) or higher, and provides the magnetic field B of 500 gauss (Gs)—600 Gs or higher. The power supply 118 is coupled to the anode 114 and the cathode 120 for the metal plating process. In some embodiments, the voltage of the power supply 118 is 0.1 V-20 V in DC and may be modulated (e.g., pulses). In one example, a waterproof solenoid coil 106 coupled to a 110 V DC power supply 116 and a metal block 108 generates a stable 500 gauss magnetic field from the anode 114 to the cathode 120 in the chemical bath chamber 102.

The metal plating apparatus 100 accelerates metal deposition by applying magnetic field B parallel to the plating current from the anode 114 to the cathode 120 inside the chemical bath chamber 102. The solenoid coil 106 generates paramagnetic force (i.e., magnetic field) and the metal block 108 enhances the magnetic field. The magnetic field increases ion current and improves metal plating deposition rate.

Because the solenoid coil 106 is within the chemical bath chamber 102 and close to the pathway between the anode 114 and the cathode 120, it can generate the magnetic field efficiently in the target area to improve the metal plating rate. In one example, the metal plating apparatus 100 achieved 20% increase in wafer per hour (WPH) production and also improved metal plating uniformity.

FIG. 2 is a schematic diagram of an exemplary metal block 108 of the metal plating apparatus 100 in FIG. 1 according to some embodiments. The metal block 108 is disposed between the anode 114 and the cathode 120. For example, the metal block 108 is placed over the anode chamber 110 and the mesh cover 112. In other embodiments, the metal block 108 may be placed below the mesh cover 112. The metal block 108 has at least one hole 202 to allow movement of the electrolyte in the chemical bath chamber 102 through the at least one hole 202.

In some embodiments, there are multiple holes 202 distributed uniformly over the metal block 108 so that the electrolyte (e.g., $CuSO_4$ solution) can move between the anode 114 and the cathode 120 uniformly in general. It is contemplated that in some embodiments, holes 202 may be distributed non-uniformly over metal block 108; for instance in some embodiments, a non-uniform distribution of holes 202 could be employed to compensate for or otherwise offset a non-uniform distribution of magnetic field B, or to compensate for non-uniform topography or deposition sites on the wafer to which the metal is to be plated, as but examples. The metal block 108 comprises iron, nickel, iron-aluminum alloy, cobalt, low carbon steel, any combination thereof, or any other suitable material. In some embodiments, the permeability of the metal block 108 is at least 100 H/m.

In some embodiments, the metal block 108 is coated with Teflon or any other suitable material so that the metal block 108 is isolated and protected from the electrolyte (e.g., $CuSO_4$ solution) within the metal plating chamber 102.

Figure 3:
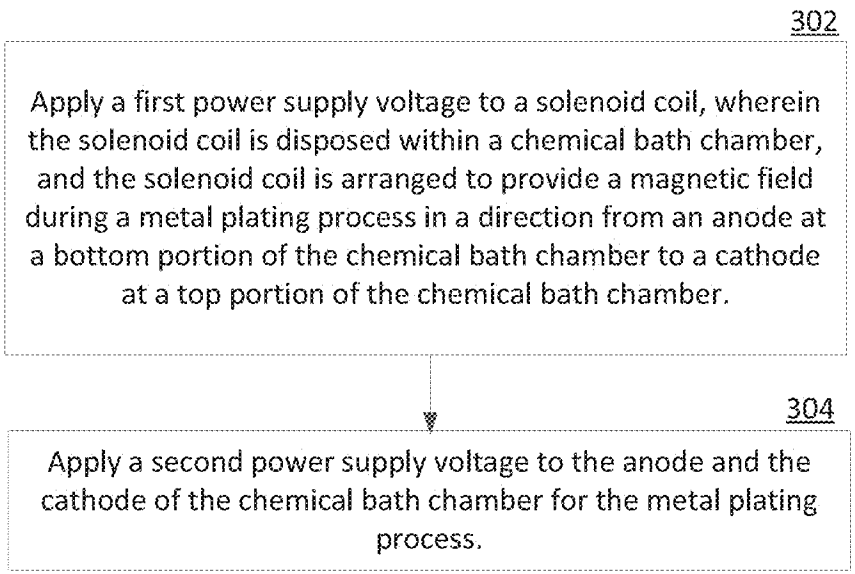
FIG. 3 is a flowchart of a method of operating the exemplary metal plating apparatus in FIG. 1 according to some embodiments.

FIG. 3 is a flowchart of a method of operating the exemplary metal plating apparatus in FIG. 1 according to some embodiments.

At step 302, a first power supply voltage is applied to a solenoid coil 106. Thee solenoid coil 106 is disposed within a chemical bath chamber 102 between an anode 114 at a bottom portion of the chemical bath chamber 102 and a cathode 120 (e.g., a wafer) at a top portion of the chemical bath chamber 102.

In some embodiments, a wafer is placed inside the chemical bath chamber 102 and functions as the cathode 120. The plating side of the wafer faces the anode 114. The solenoid coil 106 is arranged to provide a magnetic field B in a direction from the anode 114 to the cathode 120 during the metal plating process. In some embodiments, the first power supply voltage is 80 V in direct current (DC) or higher, and provides the magnetic field B of 500 gauss (Gs)—600 Gs or higher.

At step 304, a second power supply voltage is applied to the anode 114 and the cathode 120 of the chemical bath chamber 102 for the metal plating process. In some embodiments, the second power supply voltage is 0.1 V-20 V in DC.

In various embodiments, a metal block 108 is placed between the anode 114 and the cathode 120. The metal block 108 has at least one hole 202 to allow movement of an electrolyte in the chemical bath chamber 102 through the at least one hole 202. The metal block 108 comprises magnetically conductive material such as metal, e.g., iron, nickel, iron-aluminum alloy, cobalt, low carbon steel, any combination thereof, or any other suitable material. In some embodiments, the metal block 108 may have a Teflon coating to isolate and protect it from the electrolyte within the chemical bath chamber 102. In some embodiments, the permeability of the metal block 108 is at least 100 H/m.

In some embodiments, an anode chamber 110 is disposed within the chemical bath chamber 102 and inside the solenoid coil 106. The anode chamber 110 has a cylinder shape with open ends. The anode chamber 110 has a side wall that surrounds the anode 114 at the bottom portion of the chemical bath chamber 102. The anode chamber 110 comprises polyoxymethylene (POM), plastic, silicone, Teflon, any combination thereof, or any other suitable material.

In some embodiments, a mesh cover (membrane) 112 is placed over the anode chamber 110. In some embodiments, the mesh cover 112 comprises hydrophilic polyethylene, other synthetic fabric, or any other suitable material. The anode chamber 110 and the mesh cover 112 helps to contain byproducts from copper sludge and/or organic additives during the metal plating process.

According to some embodiments, a metal plating apparatus includes a chemical bath chamber, an anode disposed at a bottom portion of the chemical bath chamber, and a cathode disposed at a top portion of the chemical bath chamber. A solenoid coil is disposed within the chemical bath chamber between the anode and the cathode. The solenoid coil is arranged to apply a magnetic field during a metal plating process in a direction from the anode to the cathode.

According to some embodiments, a metal plating method includes applying a first power supply voltage to a solenoid coil. The solenoid coil is disposed within a chemical bath chamber. The solenoid coil is arranged to provide a magnetic field during a metal plating process in a direction from an anode at a bottom portion of the chemical bath chamber to a cathode at a top portion of the chemical bath chamber. A second power supply voltage is applied to the anode and the cathode of the chemical bath chamber for the metal plating process.

A skilled person in the art will appreciate that there can be many embodiment variations of this disclosure. Although the embodiments and their features have been described in detail, it should be understood that various changes, substitutions and alterations can be made herein without departing from the spirit and scope of the embodiments. Moreover, the scope of the present application is not intended to be limited to the particular embodiments of the process, machine, manufacture, and composition of matter, means, methods and steps described in the specification. As one of ordinary skill in the art will readily appreciate from the disclosed embodiments, processes, machines, manufacture, compositions of matter, means, methods, or steps, presently existing or later to be developed, that perform substantially the same function or achieve substantially the same result as the corresponding embodiments described herein may be utilized according to the present disclosure.

The above method embodiment shows exemplary steps, but they are not necessarily required to be performed in the order shown. Steps may be added, replaced, changed order, and/or eliminated as appropriate, in accordance with the spirit and scope of embodiment of the disclosure. Embodiments that combine different claims and/or different embodiments are within the scope of the disclosure and will be apparent to those skilled in the art after reviewing this disclosure.

What is claimed is:

1. A metal plating apparatus, comprising:

a chemical bath chamber;

an anode disposed at a bottom portion of the chemical bath chamber;

a cathode disposed at a top portion of the chemical bath chamber;

an anode chamber disposed within the chemical bath chamber, wherein the anode chamber has a side wall that surrounds the anode, an upper surface of the anode chamber contacting the side wall and being disposed between the anode and a metal block overlying the anode chamber and underlying the cathode, the side wall extending from the anode and ending at an upper surface of the anode chamber;

a solenoid coil, wherein the solenoid coil is disposed within the chemical bath chamber between the anode and the cathode, and wherein the solenoid coil is at least partially submerged in a liquid chemical bath, wherein a virtual line that is parallel to a major surface of the anode sequentially passes through a side wall of the chemical bath chamber, the liquid chemical bath, the solenoid coil, the liquid chemical bath, the anode, the liquid chemical bath, the solenoid coil, the liquid chemical bath, and the side wall of the chemical bath chamber; and a coil frame that provides a waterproof enclosure of the solenoid coil within the chemical bath chamber, the liquid chemical bath extending along an inner side wall and an outer side wall of the coil frame;

wherein the solenoid coil is arranged to apply a magnetic field during a metal plating process in a direction from the anode to the cathode.

2. The metal plating apparatus of claim 1, further comprising a mesh cover over the anode chamber.

3. The metal plating apparatus of claim 2, wherein the mesh cover comprises hydrophilic polyethylene.

4. The metal plating apparatus of claim 1, wherein the metal block has at least one hole to allow movement of an electrolyte in the chemical bath chamber through the at least one hole.

5. The metal plating apparatus of claim 4, wherein the metal block comprises iron, nickel, iron-aluminum alloy, cobalt, low carbon steel, or any combination thereof.

6. The metal plating apparatus of claim 4, wherein the permeability of the metal block is at least 100 H/m.

7. The metal plating apparatus of claim 4, wherein the metal block is coated with polytetrafluoroethylene.

8. The metal plating apparatus of claim 1, wherein the coil frame comprises polyoxymethylene (POM).

9. The metal plating apparatus of claim 1, further comprising a power supply coupled to the anode and the cathode.

10. The metal plating apparatus of claim 1, wherein the liquid chemical bath comprises a copper sulphate ($CuSO_4$) solution.

11. The metal plating apparatus of claim 1, wherein the chemical bath chamber comprises polytetrafluoroethylene.

12. The metal plating apparatus of claim 1, wherein the solenoid coil comprises copper.

13. A metal plating apparatus, comprising:

a chemical bath chamber;

an anode disposed at a bottom portion of the chemical bath chamber;

a cathode disposed at a top portion of the chemical bath chamber, a solenoid coil, wherein the solenoid coil is disposed within the chemical bath chamber between the anode and the cathode;

an anode chamber disposed within the chemical bath chamber and inside the solenoid coil, wherein the anode chamber has a side wall that surrounds the anode, the side wall extending from the anode and ending at an upper surface of the anode chamber, the upper surface disposed between the anode and the cathode, the upper surface comprising a mesh cover extending across the anode chamber from a first side of the anode chamber to an opposite side of the anode chamber, wherein a side wall of the mesh cover is aligned with the side wall of the anode chamber; and a magnetically conductive metal block disposed over the upper surface of the anode chamber and between the upper surface of the anode chamber and the cathode, wherein the metal block has at least one hole to allow movement of an electrolyte in the chemical bath chamber through the at least one hole, wherein the solenoid coil is arranged to apply a magnetic field during a metal plating process in a direction from the anode to the cathode.

14. The metal plating apparatus according to claim 13, wherein the solenoid coil is completely submerged in a liquid chemical bath.

15. A metal plating apparatus, comprising:

a chemical bath chamber;

a positively charged electrode disposed at a bottom portion of the chemical bath chamber;

a wafer disposed at a top portion of the chemical bath chamber in a manner that a plating side of the wafer faces the positively charged electrode, the wafer functioning as a negatively charged electrode;

an electromagnet disposed within the chemical bath chamber between the positively charged electrode and the wafer; and an electrode chamber disposed within the chemical bath chamber, wherein the electrode chamber has a side wall that surrounds the positively charged electrode, an outer surface of the side wall that faces away from the electromagnet being completely covered by a liquid chemical bath, an upper surface of the electrode chamber contacting the side wall and being disposed between the positively charged electrode and a metal block overlying the electrode chamber and underlying the wafer, wherein the side wall ends at the upper surface of the electrode chamber;

wherein the electromagnet is arranged to apply a magnetic field during a metal plating process in a direction from the positively charged electrode to the wafer.

16. The metal plating apparatus of claim 15, wherein the metal block has at least one hole to allow movement of the liquid chemical bath in the chemical bath chamber through the at least one hole.

17. The metal plating apparatus of claim 15, further comprising a coil frame that provides a waterproof enclosure of the electromagnet within the chemical bath chamber, the liquid chemical bath extending along an inner side wall and an outer side wall of the coil frame.

18. The metal plating apparatus of claim 1, wherein the inner side wall of the coil frame is opposite to the outer side wall of the coil frame, the liquid chemical bath extending between the outer side wall and the chemical bath chamber.

19. The metal plating apparatus according to claim 13, wherein the upper surface of the anode chamber is larger than an upper surface of the metal block in a plan view, and an edge of the upper surface of the anode chamber extends laterally beyond an edge of the upper surface of the metal block.

* * * * *